US006772844B2

(12) United States Patent
Lloyd et al.

(10) Patent No.: US 6,772,844 B2
(45) Date of Patent: Aug. 10, 2004

(54) HIGH PRESSURE SEALING APPARATUS AND METHOD

(75) Inventors: Sam Sun Lloyd, Houston, TX (US); James A. Simson, Meadow Place, TX (US); George Melenyzer, Tomball, TX (US)

(73) Assignee: Smith International, Inc., Houston, TX (US)

( * ) Notice: Subject to any disclaimer, the term of this patent is extended or adjusted under 35 U.S.C. 154(b) by 85 days.

(21) Appl. No.: 10/281,577

(22) Filed: Oct. 28, 2002

(65) Prior Publication Data

US 2003/0079887 A1 May 1, 2003

Related U.S. Application Data

(60) Provisional application No. 60/341,021, filed on Oct. 30, 2001.

(51) Int. Cl.[7] ..... E21B 33/12

(52) U.S. Cl. ..... 166/387; 166/118; 166/191; 166/196

(58) Field of Search ..... 166/387, 118, 166/123, 181, 191, 196

(56) References Cited

U.S. PATENT DOCUMENTS

| | | | | |
|---|---|---|---|---|
| 4,635,716 A | * | 1/1987 | Zunkel | 166/51 |
| 5,333,692 A | | 8/1994 | Baugh et al. | 166/387 |
| 5,511,620 A | | 4/1996 | Baugh et al. | 166/387 |
| 5,988,276 A | | 11/1999 | Oneal | 166/118 |
| 6,123,148 A | | 9/2000 | Oneal | 166/118 |

* cited by examiner

*Primary Examiner*—Zakiya Walker
(74) *Attorney, Agent, or Firm*—Conley Rose, P.C.

(57) ABSTRACT

A sealing apparatus for sealing an annulus between a mandrel and an outer tubular. The apparatus comprises a top seal ring and a bottom seal ring separated by a double-ramped cylinder, all mounted on the mandrel and fit within the inner diameter of the outer tubular. The sealing apparatus is placed on the mandrel in running in position. The mandrel and sealing apparatus are then placed downhole in the outer tubular. Once at the desired location, a load is applied to the top seal ring. Once the load reaches a predetermined magnitude, the ramp slides under and expands the bottom seal ring to form a pressure-tight seal with the outer tubular. Additional load placed on the top seal ring causes the top seal ring to slide over the ramp and expand. As the top seal ring expands, the top seal ring forms a pressure-tight seal with the outer tubular.

36 Claims, 4 Drawing Sheets

HIGH PRESSURE SEALING APPARATUS AND METHOD

CROSS-REFERENCE TO RELATED APPLICATIONS

The present application claims the benefit of 35 U.S.C. 119(e) provisional application Ser. No. 60/341,021 filed Oct. 30, 2001, and entitled Packer Seal.

STATEMENT REGARDING FEDERALLY SPONSORED RESEARCH OR DEVELOPMENT

Not Applicable.

BACKGROUND OF THE INVENTION

1. Field of the Invention

This invention relates to seals used in the oil and gas industry, and more particularly to a high pressure liner packer seal. In one aspect, the invention relates to radially expandable rings for use in a packer to achieve a seal of an inner tubular within a casing, for example, a well bore casing.

2. Description of the Related Art

A typical well bore has an outer tubular therein that by way of example is borehole casing. Pipe string is tripped, or run, into the well bore through the outer tubular and will typically have various subs and tools connected in-line in the string for performing various tasks in the well. In the drilling and completion of oil and gas wells, the annulus between the well bore casing and an interior tubular, for example a work string or a production string, is commonly required to be sealed. One type of such an annular seal is referred to as a packer. Packers operate with an un-set, or run-in, diameter while tripped to the desired location in the well bore. The packers are then are expanded radially outward to a set position diameter by some mechanism to seal against the inside of the well bore casing.

Packers often employ elastomeric seals. However, elastomeric seals suffer from several drawbacks. They often cannot withstand prolonged high temperature and/or high pressure. The seals may also extrude into gaps, sacrificing the sealing quality. Additionally, elastomeric seals are highly susceptible to "swabbing off" of the packer when the packer is tripped down hole due to axial forces from the fluid flow across the elastomeric seal. "swabbing off" also occurs when high circulating flow rates are used to clean the wellbore of debris or "mud cake" prior to cementing cause high axial forces across the elastomeric seal. Elastomeric seals are also subject to eventual deterioration after prolonged exposure to corrosive fluids and high temperatures. Also, when energized, elastomeric seals are likely to flow along extrusion pathways if unchecked.

Metal components can be used to obtain gas tight metal-to-metal seals, but are generally only suited for rather pristine environments other than wellbores. One problem with metal sealing components is that, like elastomeric components, metal sealing components will eventually become degraded after prolonged exposure to corrosive fluids.

A need exists for an expandable seal that can seal the annulus between the well bore casing and an inner tubular without the drawbacks of the conventional metal to metal seals or the conventional elastomeric seals. A need also exists for a packer metal to metal seal that can conform to out of round casing for proper sealing.

Hence, it is desired to provide a high performance sealing apparatus with a high flow-by and a high differential element. It is further desired to provide a sealing apparatus with a self-energizing, non-extrusion seal element design. It is a further object of this invention to provide a sealing apparatus that allows fast tripping into a well bore with an anti-swabbing off sealing element design.

Other objects, features and advantages of the invention will be apparent from the following detailed description taken in connection with the accompanying drawings.

SUMMARY OF THE PREFERRED EMBODIMENT

The preferred embodiment relates to a sealing apparatus for sealing an annulus between a mandrel and an inner surface of an outer tubular. The apparatus comprises a top seal ring and a bottom seal ring separated by a double-ramped cylinder, all of which are mounted on the outer diameter (OD) of the mandrel and fit within the inner diameter (ID) of the outer tubular. The sealing apparatus is capable of being positioned in different modes. One mode is the running in, "tripping in" mode and is used when the seal assembly is being located down hole in the outer tubular. Another mode is the set position mode where the seal rings are expanded to seal the annulus between the mandrel and the outer tubular.

The top and bottom seal rings each comprise a base with an extending expandable arm. The seal rings also each comprise an elastomeric material that covers the OD of at least the expandable arm. The base of each seal ring also comprises an inner seal that forms a fluid-tight seal between the inner surface of the base and the OD of the mandrel. The expandable arms each comprise a leading edge notch and a back-up extension. The leading edge notch is designed to fail by bending or shearing under a smaller load than the bending or shearing load for the top seal ring notch. The expandable arms also comprise an inner shoulder at the expandable arm base. The elastomeric materials cover the outer surface of each expandable arm, but with the back-up extensions extending through the elastomeric materials. The top and bottom seal rings are positioned on the mandrel such that the expandable arms face each other.

The double-ramp cylinder moveably engages the mandrel and is positioned between the top seal ring and bottom seal ring. The double-ramp cylinder comprises a top ramp surface and a bottom ramp surface. The ramp surfaces taper in towards the mandrel as they approach the top and bottom seal rings, respectively. At the end of each ramp surface is a shoulder.

In operation, the sealing apparatus is placed on the mandrel in the running in position. The mandrel includes a shoulder that prevents the bottom seal ring from sliding relative to the mandrel in the downhole direction. The mandrel and sealing apparatus are then placed downhole in the outer tubular. Once at the desired location, a load is applied to the uphole end of the top seal ring. This in turn places a load on the double-ramped cylinder through the top seal ring notch acting against the shoulder on the top ramp surface. The load further acts on the bottom seal ring through the shoulder on the bottom ramp surface acting against the bottom seal ring notch. The load is preferably applied mechanically.

Once the load reaches a predetermined magnitude, the bottom seal ring notch shears or bends, causing the bottom ramp surface to slide under and expand the expandable arm of the bottom seal ring. As the bottom seal ring expandable arm expands, the elastomeric material and the back-up extension form a pressure-tight seal against the ID of the outer tubular. Additional load placed on the top seal ring causes the top seal ring notch to shear or bend, causing the top seal ring expandable arm to slide over the top ramp surface and expand. As the top seal ring expandable arm expands, the elastomeric material and the back-up extension form a pressure-tight seal against the ID of the outer tubular. Once in the set position, the top seal ring thus additionally seals the annulus between the mandrel and the outer tubular.

Thus, the preferred and alternative embodiments comprise a combination of features and advantages that enable them to overcome various problems of prior devices. The various characteristics described above, as well as other features, will be readily apparent to those skilled in the art upon reading the following detailed description of the preferred and alternative embodiments, and by referring to the accompanying drawings.

BRIEF DESCRIPTION OF THE DRAWINGS

The present invention will be more fully understood by reference to the following figures illustrating the preferred and/or alternative embodiments of the present invention.

DETAILED DESCRIPTION OF THE PREFERRED AND ALTERNATIVE EMBODIMENTS

The present invention relates to a sealing apparatus and method and is susceptible to embodiments of different forms. The drawings and the description below disclose in detail specific embodiments of the present invention with the understanding that this disclosure is to be considered an exemplification of the principles of the invention, and is not intended to limit the invention to that illustrated and described in the disclosure. Further, it is to be fully recognized that the different teachings of the embodiments discussed below may be employed separately or in any suitable combination to produce desired results.

Figure 1:
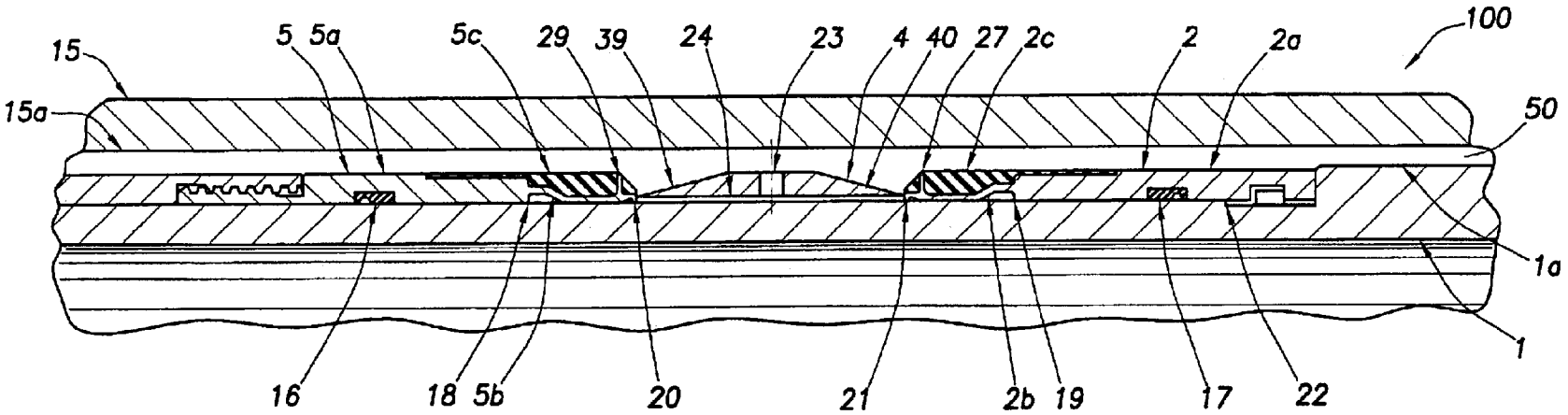
FIG. 1 is a partial section view of the preferred embodiment of the seal ring assembly in an unset position.
Figure 2:
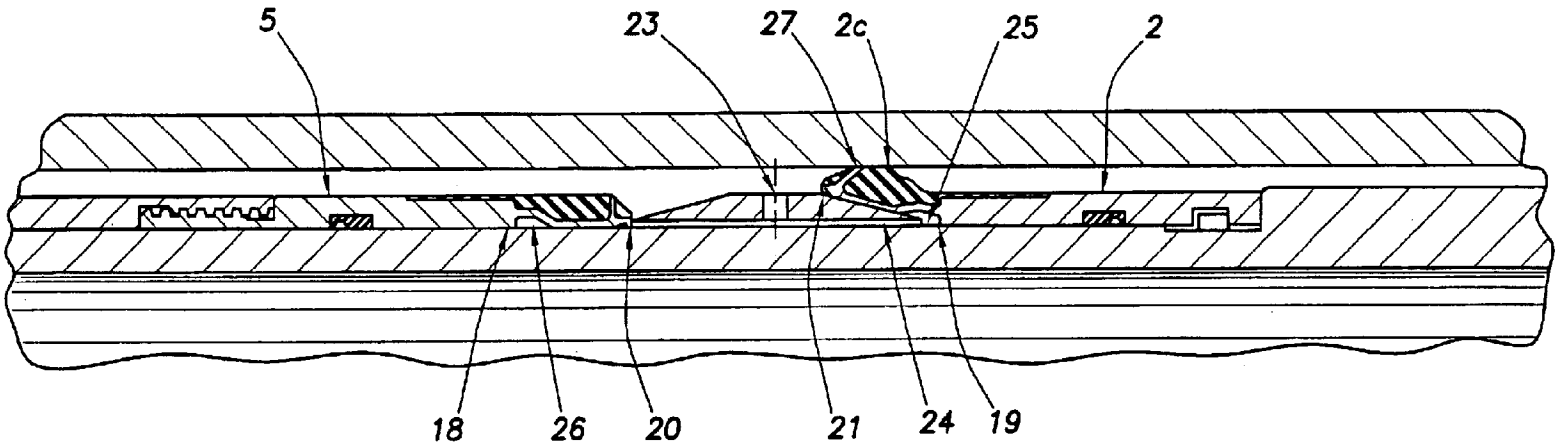
FIG. 2 is a partial section view of the preferred embodiment of the seal ring assembly in a partially set position.
Figure 3:
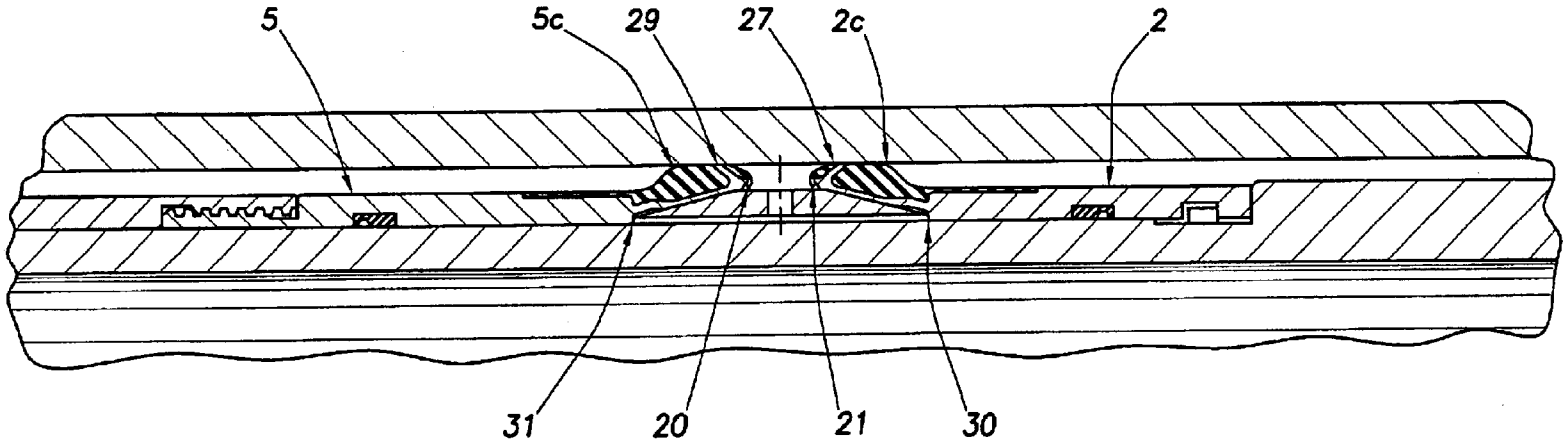
FIG. 3 is a partial section view of the preferred embodiment of the seal ring assembly in a fully set position.

Referring initially to FIGS. 1–3, there is shown a sealing apparatus 100 constructed in accordance with the preferred embodiment. The sealing apparatus 100 seals an annulus 50 between a mandrel 1 and an ID 15*a* of an outer tubular 15. The apparatus 100 comprises a top seal ring 5 and a bottom seal ring 2 separated by a double-ramped cylinder 4, all of which are mounted on the OD 1*a* of the mandrel 1 and fit within the inner diameter ID 15*a* of the outer tubular 15. The seal apparatus 100 is placed on mandrel 1 at the appropriate location relative to the various subs and tools that is known in the art. The sealing apparatus 100 is capable of being positioned in different modes. One mode is the running in, "tripping in" mode and is used when the seal assembly 100 is being located down hole in the outer tubular 15, shown in FIG. 1. Another mode is the set position mode where the seal rings 5, 2 are expanded to seal the annulus 50, as shown in FIG. 3.

The bottom seal ring 2 comprises a base 2*a* with an extending expandable arm 2*b*. The bottom seal ring 2 also comprises an elastomeric material 2*c* that is attached to and covers the OD of at least the expandable arm 2*b*. The base 2*a* further comprises an inner seal 17 that forms a fluid-tight seal between the base 2*a* and the OD 1*a* of the mandrel 1. The expandable arm 2*b* further comprises a leading edge notch 21 and a back-up extension 27. The leading edge notch 21 prevents movement of the double-ramped cylinder 4 towards the bottom seal ring 2. However, the leading edge notch 21 is designed to fail by bending or shearing under a strong enough load. The expandable arm 2*b* also comprises an inner shoulder 19 at the base of the expandable arm 2*b*. The inner shoulder 19 serves as a stop shoulder, or load limiter as discussed below. The elastomeric material 2*c* covers the outer surface of the expandable arm 2*b*. However, the back-up extension 27 extends through the elastomeric material 2*c*. Thus, the back-up extension 27 and expandable arm 2*b* act to prevent "swabbing-off" of the elastomeric material 2*c* during the running-in of the seal apparatus 100 discussed below.

The top seal ring 5 comprises a base 5*a* with an extending expandable arm 5*b*. The top seal ring 5 also comprises an elastomeric material 5*c* that is attached to and covers the OD of at least the expandable arm 2*b*. The base 5*a* further comprises an inner seal 16 that forms a fluid-tight seal between the base 5*a* and the OD 1*a* of the mandrel 1. The expandable arm 5*b* further comprises a leading edge notch 20 and a back-up extension 29. The leading edge notch 20 prevents movement of the seal ring 5 towards the double-ramped cylinder 4. However, the leading edge notch 20 is designed to fail by bending or shearing under a strong enough load. The leading edge notch 20 is also designed to require a greater amount of load for failure than the leading edge notch 21 of the seal ring 2. The expandable arm 5*b* also comprises an inner shoulder 18 at the base of the expandable arm 5*b*. The inner shoulder 18 serves as a stop shoulder, or load limiter as discussed below. The elastomeric material 5*c* covers the outer surface of the expandable arm 5*b*. However, the back-up extension 29 extends through the elastomeric material 5*c*. Thus, the back-up extension 29 and expandable arm 5*b* act to prevent "swabbing-off" of the elastomeric material 5*c* during the running-in of the seal apparatus 100 discussed below.

The double-ramp cylinder 4 moveably engages the OD 1*a* of the mandrel 1 and is positioned between the top seal ring 5 and bottom seal ring 2, with the expandable arms 5*b*, 2*b* extending towards each other. The double-ramp cylinder 4 comprises a top ramp surface 39 and a bottom ramp surface 40. The ramp surfaces 39, 40 taper in towards the mandrel 1 as they approach the top and bottom seal rings 5, 2, respectively. At the end of top ramp surface 39 is a shoulder 31 (shown in FIG. 3). At the end of bottom ramp surface 40 is a shoulder 30 (shown in FIG. 3).

In operation, the sealing apparatus 100 is placed on the mandrel 1 in the running in position shown in FIG. 1. The shoulder 1*a* prevents the bottom seal ring 2 from sliding relative to the mandrel 1 in the downhole direction. The mandrel 1 and sealing apparatus 100 are then placed downhole in the outer tubular 15. Once at the desired location, a load is applied to the uphole end of the top seal ring 5. This load translates onto the double-ramped cylinder 4 through the top seal ring notch 20 acting against the shoulder 31 on the top ramp surface 39. The load is further translated to the bottom seal ring 2 through the shoulder 30 on the bottom ramp surface 40 acting against the bottom seal ring notch 21. Preferably, the load is applied to the top seal ring 5 mechanically. However, it should be appreciated that any appropriate means known in the art, for example hydraulics, may be used to place the load on top seal ring 5. Because the mandrel shoulder 1*a* prevents any relative movement of the bottom seal ring 2*a* in the downhole direction, the load placed on the bottom seal ring 2*a* is compressive.

Once the load reaches a predetermined magnitude, the bottom seal ring notch 21 shears or bends, causing the bottom ramp surface 40 to slide under and expand the expandable arm 2*b* of the bottom seal ring 2 as shown in FIG. 2. The bottom seal ring notch 21 can be designed to fail at various loads depending on the application. As the bottom seal ring expandable arm 2*b* expands, the elastomeric material 2*c* and the back-up extension 27 form a combined elastomeric and metal-to-metal pressure-tight seal against the ID 15*a* of the outer tubular 15. Once in the set position, the bottom seal ring 2 thus seals the annulus 50 between the mandrel 1 and the outer tubular 15. The seal formed by the seal ring 2 is "self-energizing" because fluid pressure exerted from the annulus 50 below and acting across the seal ring 2 also acts to further expand the arm 2*b* and elastomeric material 2*c* into the ID 15*a* of the outer tubular 15. Continued movement of the double-ramped cylinder 4 toward the bottom seal ring 2 is prevented either by the compressive force of the expandable arm 2*b* and elastomeric material 2*c* against the ID 15*a* of the outer tubular 15 or contact of the ramp surface shoulder 30 with the expandable arm inner shoulder 19. By setting the bottom seal ring 2 first, any chance of a hydraulic lock forming between top seal ring 5 and bottom seal ring 2 is eliminated. Further, by setting the bottom seal ring 2 first, any vertical movement of the sealing apparatus 100 within the outer tubular 15, as a result of applying additional axial setting forces, is minimized.

Once the double-ramped cylinder 4 is prevented from further downhole movement, additional load placed on the top seal ring 5 causes the top seal ring notch 20 to shear or bend, causing the top seal ring expandable arm 5*b* to slide over the top ramp surface 39 and expand. The top seal ring notch 20 can be designed to fail at various loads depending on the application, but in any application is designed to fail at a load greater than that required for bottom seal ring notch 21 to fail. As the top seal ring expandable arm 5*b* expands, the elastomeric material 5*c* and the back-up extension 29 form a combined elastomeric and metal-to-metal a pressure-tight seal against the ID 15*a* of the outer tubular 15 as shown in FIG. 3. Once in the set position, the top seal ring 5 thus additionally seals the annulus 50 between the mandrel 1 and the outer tubular 50. Continued movement of the top seal ring 5 towards the double-ramped cylinder 4 is prevented either by the compressive force of the expandable arm 5*b* and elastomeric material 5*c* against the ID 15*a* of the outer tubular 15 or contact of the ramp surface shoulder 31 with the expandable arm inner shoulder 18. Thus the mating of ramp shoulder 30 with expandable arm inner shoulder 19 and ramp shoulder 31 with expandable arm inner shoulder 18 limits the amount of load that can be placed on expandable arms 2*b*, 5*b*. Limiting the amount of load on expandable arms 2*b*, 5*b* prevents straining the outer tubular 15. Limiting the amount of load also prevents the back-up extensions 27, 29 from failing. Limiting the amount of load also preferably prevents the expandable arms 2*b*, 5*b* from riding too far up the ramp surfaces 40, 39 respectively, thus making the seals vulnerable to failure due to not being supported by the ramp surfaces 40, 39 respectively. However, it should be appreciated that the seals formed by seal rings 2, 5 do not have to be completely supported by ramp surfaces 40, 39 to be within the scope of the invention.

In the preferred embodiment, once set, the sealing apparatus 100 will be able to resist 10,000 psi at 350 degrees Fahrenheit. However, it should be appreciated that the sealing apparatus 100 will be able to resist other pressures at various temperatures as well without departing from the scope of the invention.

As shown in FIG. 3, once set, seal rings 5, 2 are "self-energizing". Once set, pressure from the annulus 50 energizes the elastomeric materials 5*c*, 2*c*, resulting in increased pressure on the elastomeric materials 5*c*, 2*c*. In turn, the elastomeric materials 5*c*, 2*c*, are pushed against the respective back-up extensions 29, 27, urging the back-up extensions 29, 27 to expand radially towards the inner diameter 15*a* of the outer tubular 15 and further resulting in a pressure-tight seal. Likewise, compressive forces from the annulus 50 fluid pressure cause the seal ring bases 5*a*, 2*a* to compress against the mandrel 1 to form a pressure-tight seal between the mandrel 1 and the seal rings 5, 2. Seals 16, 17 further facilitate forming a pressure-tight seal between the mandrel 1 and seal rings 5, 2, respectively. In addition, having two seals formed by the seal rings 5, 2 allows for protection against complete failure of the overall seal should one of the seals fail. Thus, if the seal formed by top seal ring 5 were to fail, the seal formed by bottom seal ring 2 under certain circumstances would be able to sufficiently seal the annulus between the mandrel 1 and the outer tubular 15.

Figure 4:
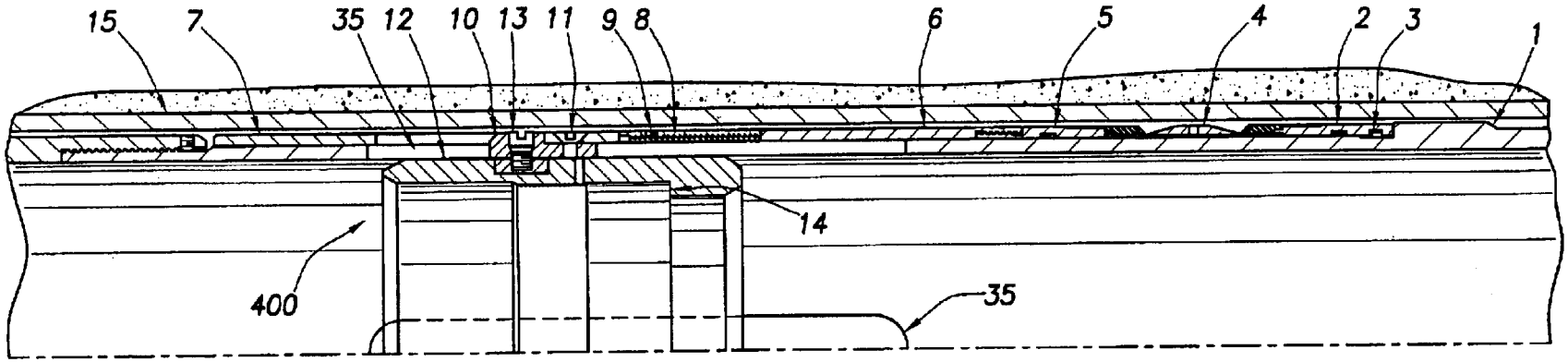
FIG. 4 is a half cross-sectional view of the preferred embodiment of the sealing apparatus of the present invention in an unset position.
Figure 5:
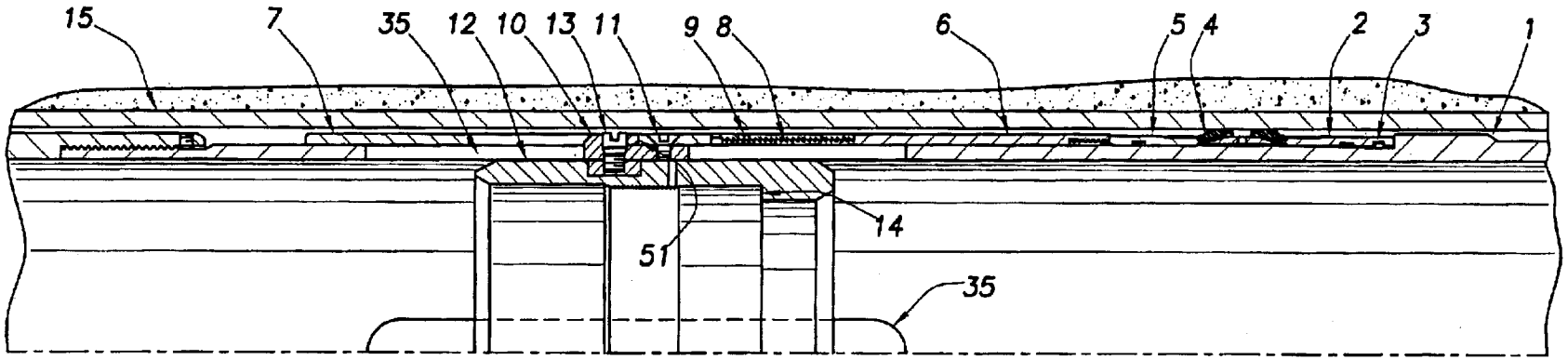
FIG. 5 is a half cross-sectional view of the preferred embodiment of the sealing apparatus of the present invention in a set position but before the maximum set load shearing pin has been sheared.
Figure 6:
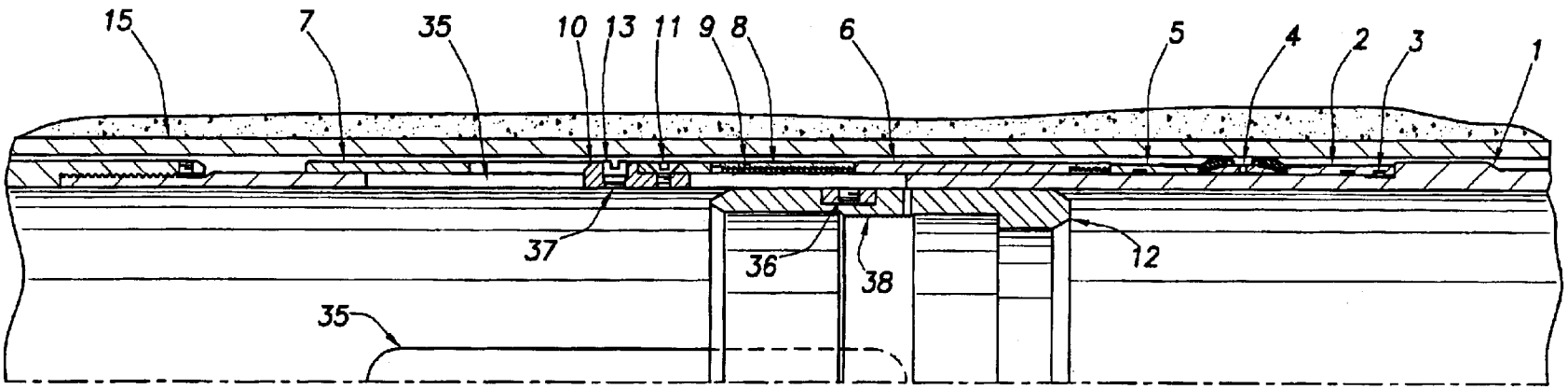
FIG. 6 is a half cross-sectional view of the preferred embodiment of the sealing apparatus of the present invention in a set position after the maximum set load shearing pin has been sheared.

Referring now to FIGS. 4–6, there is shown an example of a setting means 400 for placing a load on the seal apparatus 100 constructed in accordance with the preferred embodiment. As discussed above, the seal apparatus 100 moves from the running-in mode to the set mode by placing an axial load on the top seal ring 5. This can be accomplished by many means known by those skilled in the art, of which the setting means 400 is an example. The setting means 400 comprises a setting sleeve 12 disposed inside the mandrel 1. The setting sleeve 12 includes a load shoulder 14 for transferring load from a load inducing downhole tool (not shown). A shear screw 13 engages the sleeve 12 through a setting key 10. Thus, the shear screw 13 allows the setting sleeve 12 to transfer a load to the setting key 10. The setting key 10 in turn slidingly engages a slot 35 in the mandrel 1. The setting key 10 attaches to ratchet retainer ring 7 with screw 11 and also engages a shoulder 51 in the ratchet retainer ring 7 such that shoulder 51 allows the setting key 10 to transfer a load to the ratchet retainer ring 7. The ratchet retainer ring 7 in turn engages an extension ring 6 such that the ratchet retainer ring 7 can transfer a load to the extension ring 6. The extension ring 6 in turn engages an top seal ring 5 such that the extension ring 6 can transfer a load to the extension ring 6. The engagement means of the ratchet retainer ring 7 to the extension ring 6 and extension ring 6 to the top seal ring 5 are preferably threads. However, it should be appreciated that any suitable means known to those skilled in the art may be used.

In operation, a load inducing downhole tool (not shown) is lowered downhole into the mandrel land set on the load shoulder 14 of the setting sleeve 12. The load inducing tool thus places a load on the setting sleeve 12 through the shoulder 14. The setting sleeve 12 in turn transfers that load through the shear screw 13 to the setting key 10. The setting key 10 then in turn transfers the load to the ratchet retainer ring 7 through the shoulder 51. The ratchet retainer ring 7 then transfers the load to the extension ring 6, which in turn transfers the load to the top seal ring 5. As the load proceeds to cause the setting of the seal apparatus 100, the setting sleeve 12, the shear screw 13, the setting key 10, the screw 11, the ratchet retainer ring 7, and the extension ring 6 all move toward bottom seal ring 2 with the seal ring 5 as shown in FIG. 5. Once the seal apparatus 100 is set, any additional load becomes compressive because the setting means 400 is not able to move any further axially under the load. Thus, additional load causes the shear screw 13 to shear as shown in FIG. 6, separating the setting sleeve 12 from the setting means 400. Once separated, a downhole tool (not shown) may be used to engage the separated setting sleeve 12 for retrieval. It should be appreciated that the example setting means 400 may be constructed in any appropriate manner to affect placing a load on top seal ring 5. For example, the setting ring 12 may run in the annulus 50 between the mandrel 1 and the outer tubular 15 and be actuated hydraulically.

Figure 7:
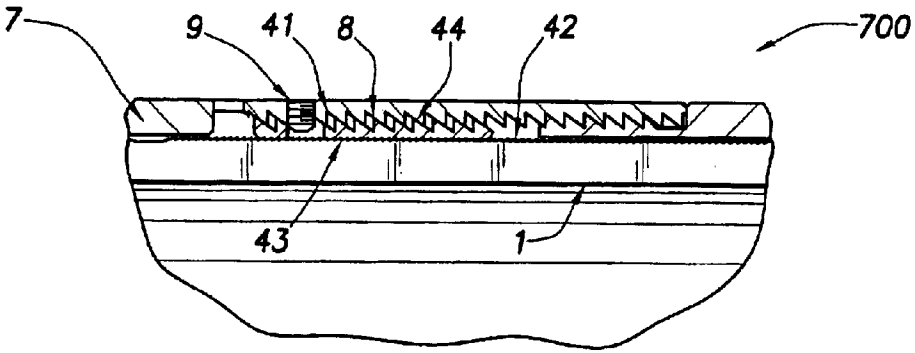
FIG. 7 is a partial section view of the preferred embodiment of the locking or anti-unsetting ratchet assembly.

Referring now to FIGS. 4 and 7, there is shown an optional ratchet means 700 for preventing movement of the seal apparatus 100 in the uphole direction. Ratchet means 700 comprises the ratchet retainer ring 7, a ratchet ring 8, a screw 9, and the extension ring 6. The ratchet retainer ring includes locking threads 41 that engage with the ratchet ring locking threads 44. The ratchet ring 8 is cut axially in one location to allow freedom to engage mandrel 1. The side of the ratchet ring 8 facing the mandrel 1 includes additional ratchet threads 43 that engage ratchet threads 42 on the mandrel 1. Ratchet ring 8 engages ratchet retainer ring 7 through screw 9. The screw 9 locates the ratchet ring 8 with respect to ratchet retainer ring 7 and ensures proper orientation of the ratchet threads 41, 44 during assembly. In operation, the ratchet ring and mandrel ratchet threads, 43, 42 allow movement of the ratchet retainer ring 7 and ratchet ring 8 in the downhole direction. Movement in the downhole direction allows the seal apparatus 100 to move from the running-in mode to the set mode. If the seal apparatus were to un-set, the seal ring 5 and the extension ring 6 would need to move in the uphole direction. As the extension ring 6 attempts to move in the uphole direction, it compresses the ratchet ring 8 into the mandrel 1 through the engagement of the ratchet retainer ring ratchet threads 41 and the ratchet ring ratchet threads 44. Compressing the ratchet ring 8 into the mandrel causes the ratchet ring threads 43 to engage the mandrel ratchet threads 42, which prevents movement of the ratchet ring 8 in the uphole direction. The engagement of the ratchet ring 8 and the mandrel 1 prevents movement of the extension ring 6 in the uphole direction due to the engagement of the ratchet ring 8 with the ratchet retainer ring 7 and the engagement of ratchet retainer ring 7 with the extension ring 6. Therefore, ratchet means 700 prevents movement of ratchet retainer ring 7 and the extension ring 6 in the uphole direction relative to the mandrel 1. Thus, the ratchet means 700 prevents the un-setting of the seal apparatus 100 once placed in the set position.

Figure 8:
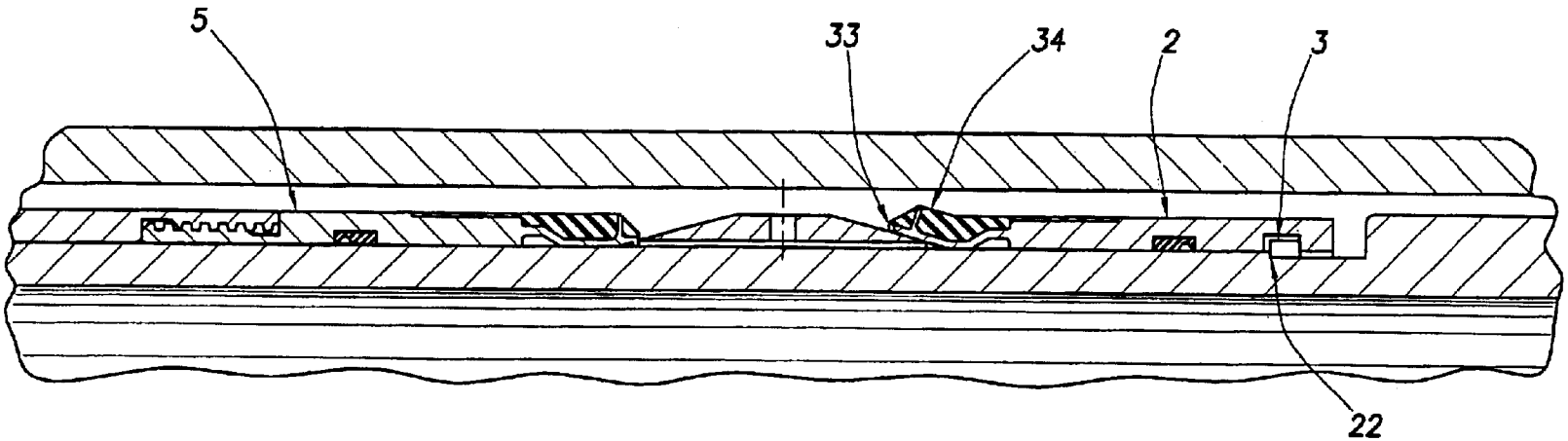
FIG. 8 is a partial section view of the preferred embodiment of the seal ring assembly in an unset position showing the performance of the anti-preset assembly.

Referring now to FIGS. 1 and 8, there is shown an optional anti-set ring 3 that prevents the bottom seal ring 2 from moving too far in the uphole direction relative to the mandrel 1, and thus moving into the set position prematurely. The anti-set ring 3 operates with an anti-set shoulder 22 as shown in FIG. 8 to prevent bottom seal ring 2 from being moved into the set position on double-sided ramp 4. During run-in, the bottom seal ring 2 can be moved in the uphole direction relative to the mandrel 1 due to an unforeseen load in the uphole direction placed on the downhole side of the bottom seal ring base 2*a*. Such an unforeseen load may result from obstructions in the annulus 50 or from sudden increases in annulus 50 fluid pressure. In operation, the unforeseen load acts on the bottom seal ring 2, pushing the seal ring 2 in the uphole direction and prematurely into the set position. As the bottom seal ring moves in the uphole direction relative to the mandrel 1, the anti-set ring 3 engages the anti-set shoulder 22 as shown in FIG. 8 to prevent further movement of the bottom seal ring 2 in the uphole direction. The anti-set ring 3 and the anti-set shoulder 22 prevent the premature movement of the bottom seal ring 2 into the set position. Thus, the anti-set ring 3 and the anti-set shoulder 22 prevent the seal apparatus 100 from setting prematurely during the run-in of the mandrel 1 and the seal apparatus 100 into the outer tubular.

Referring again to FIGS. 1 and 2, there is shown an optional anti-pressure build-up hole 23 and axial groove 24 located in the double-sided ramp 4. The bottom seal ring 2 forms a cavity 25 between the expandable arm 2*b* and the mandrel 1. The hole 23 communicates with the cavity 25 through the axial groove 24. As the seal apparatus is set, the ramp surface 40 of the double-sided ramp 4 slides under and expands expandable arm 2*b*. As the double-sided ramp 4 slides under the expandable arm 2*b*, the ramp surface 40 extends into the cavity 25. If the fluid originally contained in the cavity 25 is not allowed to escape, the pressure of the fluid in cavity 25 can increase due to the decrease in volume of the cavity 25. The increased cavity pressure can then affect the integrity of the seal formed by the bottom seal ring 2. The hole 23 and groove 24 prevent the build-up of pressure by allowing the fluid in the cavity 25 to escape into the annulus 50 as the seal is formed. In addition, the groove 24 extends across the double-sided ramp 4 and communicates with a cavity 26 formed between top seal ring expandable arm 5*b* and the mandrel 1. Thus, the grooves 23, 24 act to prevent pressure build-up in cavity 26 in the same way as the grooves 23, 24 prevent pressure build-up in cavity 25.

While preferred and alternative embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A seal apparatus for sealing an annulus between a mandrel with an outer diameter and an outer tubular, the apparatus comprising:

a first seal ring moveably engaging the outer diameter of the mandrel;

a second seal ring engaging the outer diameter of the mandrel;

a double-ramp cylinder moveably engaging the outer diameter of the mandrel, the double-ramped cylinder being positioned between the first seal ring and the second seal ring;

a means for limiting the movement of the second seal ring in the axial direction away from the double-ramped cylinder;

wherein the seal apparatus is operable in a running-in position wherein the first and second seal rings are maintained out of contact with the outer tubular; and wherein the seal apparatus is operable in a sealing position wherein the first and second seal rings form at least one fluid seal with the outer tubular.

2. The seal apparatus of claim 1 wherein the at least one fluid seal is self-energizing in the sealing position.

3. The seal apparatus of claim 1 wherein the means for limiting the movement of the second seal ring in the axial direction away from the double-ramped cylinder comprises a shoulder on the mandrel.

4. The seal apparatus of claim 1 further comprising a setting means for applying an axial load to the seal apparatus to convert the seal apparatus from the running-in position to the sealing position.

5. The seal apparatus of claim 4 wherein the axial load is applied mechanically.

6. The seal apparatus of claim 4 wherein the axial load is applied hydraulically.

7. The seal apparatus of claim 4 wherein the setting means comprises a setting ring engageable with the mandrel for receiving an axial load and for transferring the axial load directly or indirectly to the seal apparatus.

8. The seal apparatus of claim 1 further comprising a ratchet ring that engages the outer diameter of the mandrel to prevent movement of the second seal ring from the sealing position to the running-in position.

9. The seal apparatus of claim 1 further comprising an anti-set snap ring that engages the outer diameter of the mandrel and the second seal ring to prevent movement of the second seal ring towards the double-ramped cylinder.

10. The seal apparatus of claim 1 wherein:

the first seal ring comprises:

a first base having a first inner seal that forms a fluid-tight seal between the first base and the mandrel;

a first expandable arm extending from the first base, the first expandable arm comprising a first leading edge notch and a first back-up extension; and a first elastomeric material covering the first expandable arm, the first back-up extension extending through the first elastomeric material;

the second seal ring comprises:

a second base having a second inner seal that forms a fluid-tight seal between the second base and the mandrel;

a second expandable arm extending from the second base, the second expandable arm comprising a second leading edge notch and a second back-up extension; and a second elastomeric material covering the second expandable arm, the second back-up extension extending through the second elastomeric material; and the double-ramp cylinder comprises a first ramp surface with a first outer shoulder and a second ramp surface with a second outer shoulder.

11. The seal apparatus of claim 10 wherein the first back-up extension is capable of restricting removal of the first elastomeric material from the first seal ring at least while the seal apparatus is in the running-in position and the second back-up extension is capable of restricting removal of the second elastomeric material from the second seal ring at least while the seal apparatus is in the running-in position.

12. The seal apparatus of claim 10 wherein the at least one fluid seal is self-energizing in the sealing position.

13. The seal apparatus of claim 10 further comprising a setting means for applying an axial load to the seal apparatus to convert the seal apparatus from the running-in position to the sealing position.

14. The seal apparatus of claim 13 wherein the axial load is applied mechanically.

15. The seal apparatus of claim 13 wherein the axial load is applied hydraulically.

16. The seal apparatus of claim 13 wherein the setting means comprises a setting ring engageable with the mandrel for receiving an axial load and for transferring the axial load directly or indirectly to the seal apparatus.

17. The seal apparatus of claim 13 wherein the first and second leading edge notches prevent the seal apparatus from converting from the running-in position to the sealing position by engaging the first and second ramp outer shoulders respectively to prevent movement of the first and second seal rings toward the double-ramped cylinder and where the axial load is sufficient to bend or shear the first and second leading edge notches to allow movement of the first and second seal rings towards the double-ramped cylinder.

18. The seal apparatus of claim 16 wherein the first and second leading edge notches prevent the seal apparatus from converting from the running-in position to the sealing position by engaging the first and second ramp outer shoulders respectively to prevent movement of the first and second seal rings toward the double-ramped cylinder and where the axial load is sufficient to bend or shear the first and second leading edge notches to allow movement of the first and second seal rings towards the double-ramped cylinder.

19. The seal apparatus of claim 10 wherein the first and second seal rings form the at least one fluid seal by expanding the first expandable arm over the first ramp surface and expanding the second expandable arm over the second ramp surface such that the first and second elastomeric materials and first and second back-up extensions are forced into sealing contact with the outer tubular.

20. The seal apparatus of claim 10 wherein the double-ramped cylinder further comprises a pressure relief channel for relieving pressure from a first cavity under the first expandable arm as the first expandable arm expands over the first ramp surface and from a second cavity under the second expandable arm as the second expandable arm expands over the second ramp surface.

21. The seal apparatus of claim 10 further comprising a ratchet ring that engages the outer diameter of the mandrel to prevent movement of the second seal ring from the sealing position to the running-in position.

22. The seal apparatus of claim 10 further comprising an anti-set snap ring that engages the outer diameter of the mandrel and the second seal ring to prevent movement of the second seal ring towards the double-ramped cylinder.

23. A seal apparatus for sealing an annulus between a mandrel having an outer diameter and an outer tubular, the apparatus comprising:

a first seal ring moveably engaging the outer diameter of the mandrel, the first seal ring comprising:

a first base having a first inner seal that forms a fluid-tight seal between the first base and the mandrel;

a first expandable arm extending from the first base, the first expandable arm comprising a first leading edge notch and a first back-up extension; and a first elastomeric material covering the first expandable arm, the first back-up extension extending through the first elastomeric material;

a second seal ring moveably engaging the outer diameter of the mandrel, the second seal ring comprising:

a second base having a second inner seal that forms a fluid-tight seal between the second base and the mandrel;

a second expandable arm extending from the second base, the second expandable arm comprising a second leading edge notch and a second back-up extension; and a second elastomeric material covering the second expandable arm, the second back-up extension extending through the second elastomeric material;

a double-ramp cylinder moveably engaging the mandrel and positioned between the first seal ring and the second seal ring, the double-ramp cylinder comprising a first ramp surface with a first outer shoulder and a second ramp surface with a second outer shoulder;

wherein a shoulder on the mandrel limits the movement of the second seal ring in the axial direction away from the double-ramped cylinder;

wherein the seal apparatus is operable in a running-in position wherein the first and second seal rings are maintained out of contact with the outer tubular; and wherein the seal apparatus is operable in a sealing position wherein the first expandable arm is expanded over the first ramp surface and the second expandable arm is expanded over the second ramp surface such that the first and second elastomeric materials and first and second back-ups are forced into sealing contact with the outer tubular to form fluid seals.

24. The seal apparatus of claim 23 wherein the fluid seals are self-energizing in the sealing position.

25. The seal apparatus of claim 23 further comprising a setting means for applying an axial load to the seal apparatus to convert the seal apparatus from the running-in position to the sealing position.

26. The seal apparatus of claim 25 wherein the axial load is applied mechanically.

27. The seal apparatus of claim 25 wherein the axial load is applied hydraulically.

28. The seal apparatus of claim 25 wherein the setting means comprises a setting ring engageable with the mandrel for receiving an axial load and for transferring the axial load directly or indirectly to the seal apparatus.

29. The seal apparatus of claim 25 wherein the first and second leading edge notches prevent the seal apparatus from converting from the running-in position to the sealing position by engaging the first and second ramp outer shoulders respectively to prevent movement of the first and second seal rings toward the double-ramped cylinder and where the axial load is sufficient to bend or shear the first and second leading edge notches to allow movement of the first and second seal rings towards the double-ramped cylinder.

30. The seal apparatus of claim 28 wherein the first and second leading edge notches prevent the seal apparatus from converting from the running-in position to the sealing position by engaging the first and second ramp outer shoulders respectively to prevent movement of the first and second seal rings toward the double-ramped cylinder and where the axial load is sufficient to bend or shear the first and second leading edge notches to allow movement of the first and second seal rings towards the double-ramped cylinder.

31. The seal apparatus of claim 23 wherein the first back-up extension is capable of restricting removal of the first elastomeric material from the first seal ring at least while the seal apparatus is in the running-in position and the second back-up extension is capable of restricting removal of the second elastomeric material from the second seal ring at least while the seal apparatus is in the running-in position.

32. The seal apparatus of claim 23 wherein the double-ramped cylinder further comprises a pressure relief channel for relieving pressure from a first cavity under the first expandable arm as the first expandable arm expands over the first ramp surface and from a second cavity under the second expandable arm as the second expandable arm expands over the second ramp surface.

33. The seal apparatus of claim 23 further comprising a ratchet ring that engages the outer diameter of the mandrel to prevent movement of the second seal ring from the sealing position to the running-in position.

34. The seal apparatus of claim 23 further comprising an anti-set snap ring that engages the outer diameter of the mandrel and the second seal ring to prevent movement of the second seal ring towards the double-ramped cylinder.

35. A method of forming a fluid seal between a mandrel with an outer diameter and an outer tubular, the method comprising:

providing a seal apparatus having a first seal ring moveably engaging the outer diameter of the mandrel, a second seal ring engaging the outer diameter of the mandrel, and a double-ramp cylinder moveably engaging the outer diameter of the mandrel, the double-ramped cylinder being positioned between the first seal ring and the second seal ring; preventing movement of the second seal ring in the axial direction away from the double-ramped cylinder;

running the seal apparatus into the outer tubular to a pre-determined location while maintaining the first and second seal rings out of contact with the outer tubular;

applying an axial load to the seal apparatus to move the first seal ring and double-ramped cylinder towards the first seal ring and expand the first and second seal rings to create a fluid seal between the mandrel and the outer tubular with the first and second seal rings.

36. A method of forming a fluid seal between a mandrel with an outer diameter and an outer tubular, the method comprising:

providing a seal apparatus comprising:

a first seal ring moveably engaging the outer diameter of the mandrel, the first seal ring comprising:

a first base having a first inner seal that forms a fluid-tight seal between the first base and the mandrel;

a first expandable arm extending from the first base, the first expandable arm comprising a first leading edge notch and a first back-up extension; and a first elastomeric material covering the first expandable arm, the first back-up extension extending through the first elastomeric material;

a second seal ring moveably engaging the outer diameter of the mandrel, the second seal ring comprising:

a second base having a second inner seal that forms a fluid-tight seal between the second base and the mandrel;

a second expandable arm extending from the second base, the second expandable arm comprising a second leading edge notch designed to bend or shear under a lower load than the first leading edge notch and a second back-up extension; and a second elastomeric material covering the second expandable arm, the second back-up extension extending through the second elastomeric material;

a double-ramp cylinder moveably engaging the mandrel and positioned between the first seal ring and the second seal ring, the double-ramp cylinder comprising a first ramp surface with a first outer shoulder and a second ramp surface with a second outer shoulder;

preventing movement of the second seal ring in the axial direction away from the double-ramped cylinder;

running the seal apparatus into the outer tubular to a pre-determined location and maintaining the first and second seal rings out of contact with the outer tubular by engaging the first and second leading edge notches with the first and second ramp outer shoulders to prevent movement of the first and second seal rings toward the double-ramped cylinder;

applying an axial load to the seal apparatus sufficient to bend or shear the second leading edge notch and allow movement of the first seal ring and double-ramped cylinder towards the first seal ring and thus expanding the second expandable arm to create a fluid seal between the mandrel and the outer tubular with the second elastomeric material and the second back-up extension; and applying an axial load to the seal apparatus sufficient to bend or shear the first leading edge notch and allow movement of the first seal ring towards the double-ramped cylinder and thus expanding the first expandable arm to create a fluid seal between the mandrel and the outer tubular with the first elastomeric material and the first back-up extension.

* * * * *